US007814587B2

(12) United States Patent
Thomas

(10) Patent No.: US 7,814,587 B2
(45) Date of Patent: Oct. 19, 2010

(54) APPARATUS FOR APPLYING MOTION SIMULATING A MOVING VEHICLE TO AN INFANT'S CARRIER

(76) Inventor: Frank V. Thomas, 8112 Kingsbury Blvd., St. Louis, MO (US) 63105

( * ) Notice: Subject to any disclaimer, the term of this patent is extended or adjusted under 35 U.S.C. 154(b) by 0 days.

(21) Appl. No.: 12/018,271

(22) Filed: Jan. 23, 2008

(65) Prior Publication Data

US 2009/0183310 A1 Jul. 23, 2009

(51) Int. Cl.
*A47D 9/02* (2006.01)

(52) U.S. Cl. ..... 5/109; 5/108; 5/105; 297/260.1

(58) Field of Classification Search ..... 5/101, 5/102, 103, 104, 105, 106, 107, 108, 109; 297/260.1, 260.2; 472/118; 180/166
See application file for complete search history.

(56) References Cited

U.S. PATENT DOCUMENTS

| | | | | |
|---|---|---|---|---|
| 3,119,125 | A | 1/1964 | Hayes | |
| 4,028,753 | A | 6/1977 | Rios | |
| 4,258,446 | A | 3/1981 | McAllister et al. | |
| 4,366,587 | A | 1/1983 | Takada | |
| 4,656,680 | A | 4/1987 | Wilson | |
| 4,752,980 | A | 6/1988 | Nafte | |
| 4,911,499 | A | 3/1990 | Meeker | |
| 4,934,997 | A | 6/1990 | Skakas | |
| 5,183,457 | A * | 2/1993 | Gatts et al. | 600/21 |
| 5,685,601 | A | 11/1997 | Corriveau | |
| 5,711,045 | A | 1/1998 | Caster et al. | |
| 5,806,924 | A | 9/1998 | Gonas | |
| 6,966,082 | B2 | 11/2005 | Bloemer et al. | |
| 7,036,880 | B1 | 5/2006 | Goodman | |
| 2002/0046424 | A1 * | 4/2002 | Saringer | 5/665 |

FOREIGN PATENT DOCUMENTS

| | | | |
|---|---|---|---|
| JP | 56013224 | A | 2/1981 |
| JP | 3004887 | U | 9/1994 |

* cited by examiner

*Primary Examiner*—Robert G Santos
*Assistant Examiner*—Brittany M Wilson
(74) *Attorney, Agent, or Firm*—Grace J. Fishel

(57) ABSTRACT

An apparatus for applying a motion simulating a moving vehicle to an infant's carrier. A platform supporting the carrier is suspended on flexible members in an open-topped enclosure. A pair of crank shafts with cranks upon which are mounted frictional members positioned under the platform. The frictional members cause the platform to rise and fall and sets it into complex motion on the flexible members while the motion of the frictional members gently bounces an infant in the carrier. By varying the length of the flexible members and the speed of the crank shafts, a user may find a setting effective at calming the infant and inducing sleep.

16 Claims, 6 Drawing Sheets

APPARATUS FOR APPLYING MOTION SIMULATING A MOVING VEHICLE TO AN INFANT'S CARRIER

BACKGROUND OF THE INVENTION

1. Field of the Invention

The present invention relates to an apparatus for simulating the complex motions applied to a passenger in an automobile, which motions are known to have a soporific effect on infants.

2. Brief Description of the Prior Art

It is well known that a car ride tends to put an infant to sleep. The motions in a car are very complex and involve all six degrees of motion—namely, moving forward and backward (surging), moving left and right (swaying), moving up and down (heaving), tilting up and down (pitching), turning left and right (yawing) and tilting side to side (rolling). Coupled with these motions is a gentle vibration or hum imparted by the engine and rolling wheels. This combination of motions and sounds has a soothing, soporific effect on an infant.

But it is not always convenient to take an infant for a drive just to put him or her to sleep. Moreover, the effect of the drive may be lost when the car stops if that causes the infant to awaken. What is therefore needed is an apparatus that can be used in the home or in the baby's room for applying a motion that simulates a moving vehicle.

There are many prior art devices to rock a baby to sleep. These devices, however, do not simulate the full range of motions imparted by a moving vehicle. Most of the devices either rock the baby side-to-side, up-and-down or back-and-forth and none, insofar as known, are as effective as a car ride.

BRIEF SUMMARY OF THE INVENTION

In view of the above, it is an object of the present invention to provide an apparatus for applying motion simulating a moving vehicle to an infant in a carrier to induce sleep. It is another object to provide an apparatus for keeping an infant in a sleeping state after coming back from a drive. Other objects and features of the invention will be in part apparent and in part pointed out hereinafter.

In accordance with the invention an apparatus for simulating the complex motions applied to an infant's carrier in a moving vehicle is provided. In major part, the apparatus includes an open-topped enclosure in which a platform for supporting a carrier for an infant, such as a car seat, is suspended on flexible members. A pair of spaced apart crank shafts with out-of-phase cranks are positioned below the platform. Frictional members are mounted on the cranks and set the platform into complex motion on the flexible supports. By varying the speed at which the rotary drive means turns the crank shafts and the height of the platform, a user can find a setting effective at calming the infant and inducing sleep in most cases.

The invention summarized above comprises the constructions hereinafter described, the scope of the invention being indicated by the subjoined claims.

BRIEF DESCRIPTION OF THE SEVERAL VIEWS OF THE DRAWING

In the accompanying drawings, in which several of various possible embodiments of the invention are illustrated, corresponding reference characters refer to corresponding parts throughout the several views of the drawings in which.

DETAILED DESCRIPTION OF THE INVENTION

Figure 1:
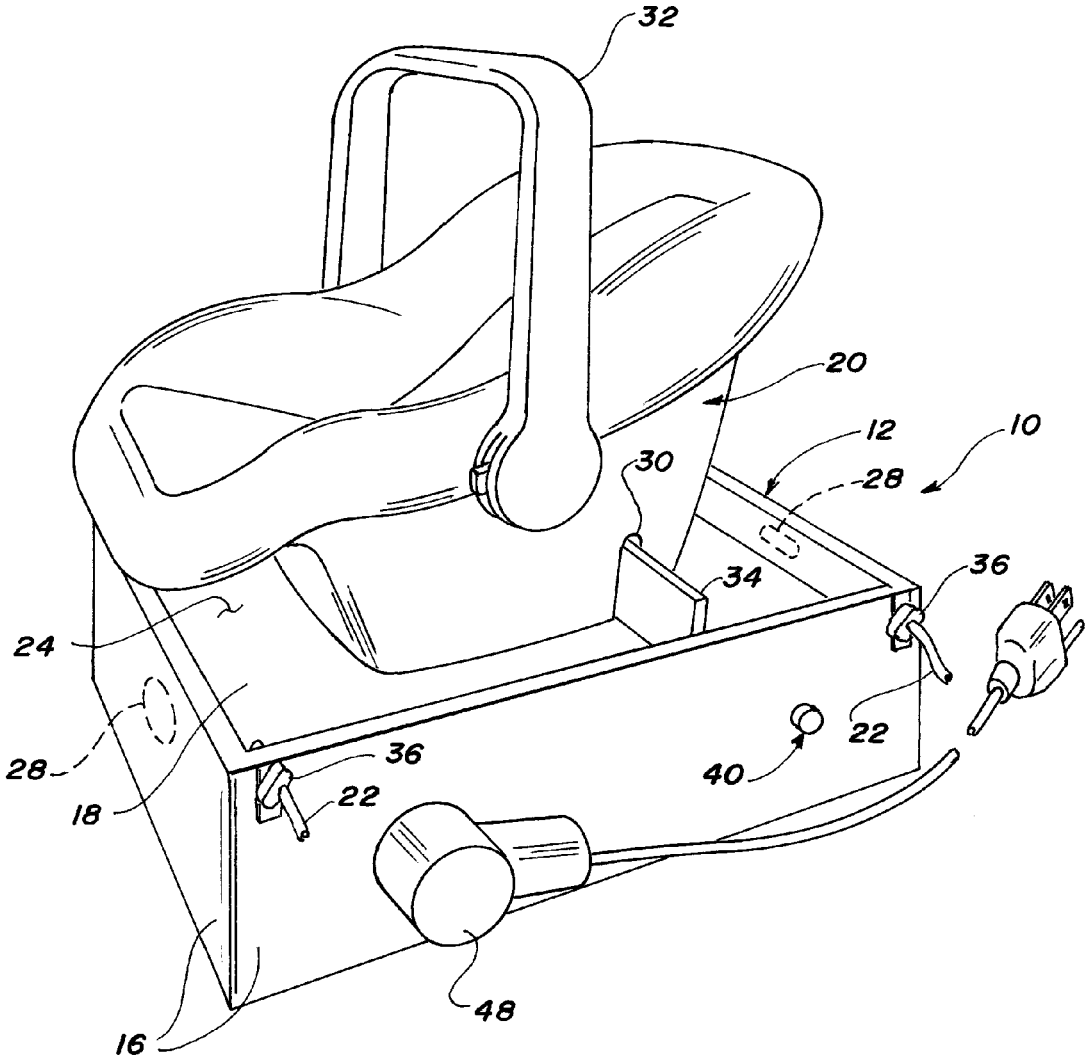
FIG. 1 is a perspective view of a first apparatus for applying motion simulating a moving vehicle to a carrier for an infant.
Figure 2:
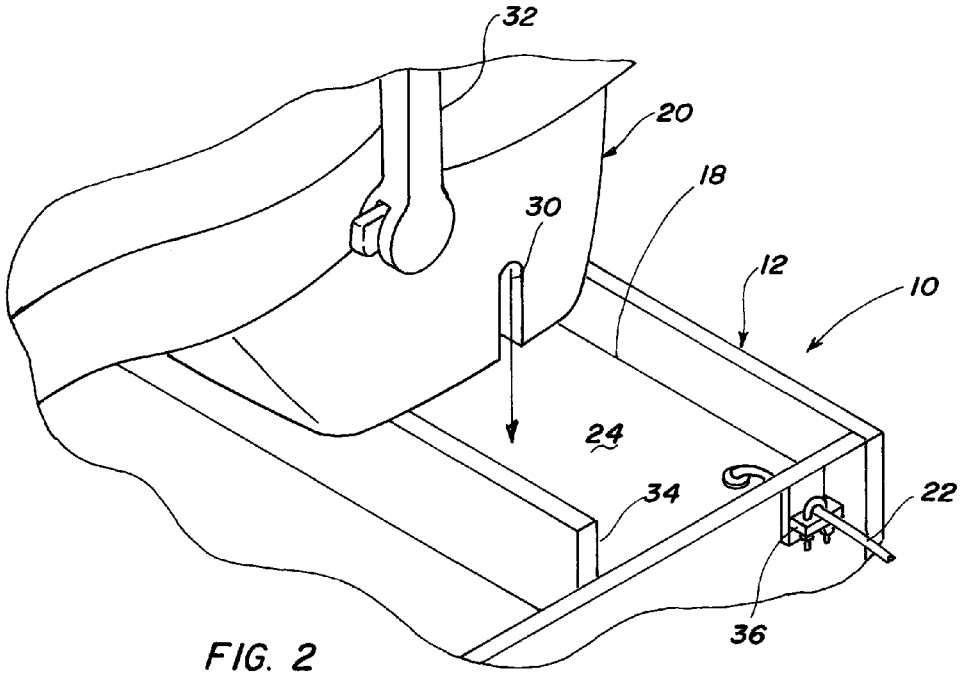
FIG. 2 is a detail illustrating one possible way to attach the carrier to the apparatus.
Figure 4:
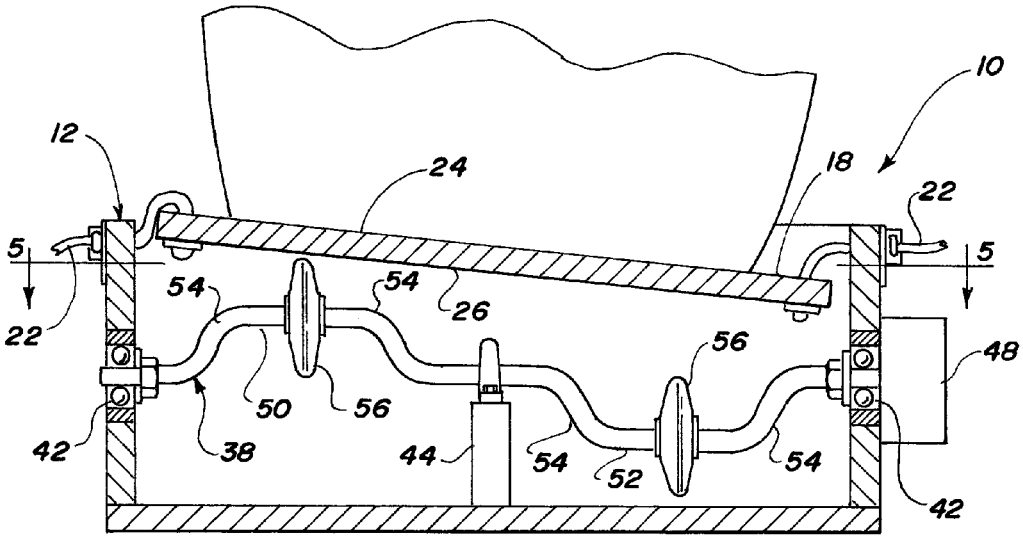
FIG. 4 is an end elevation in cross-section taken along a plane 4-4 in FIG. 7.
Figure 3:
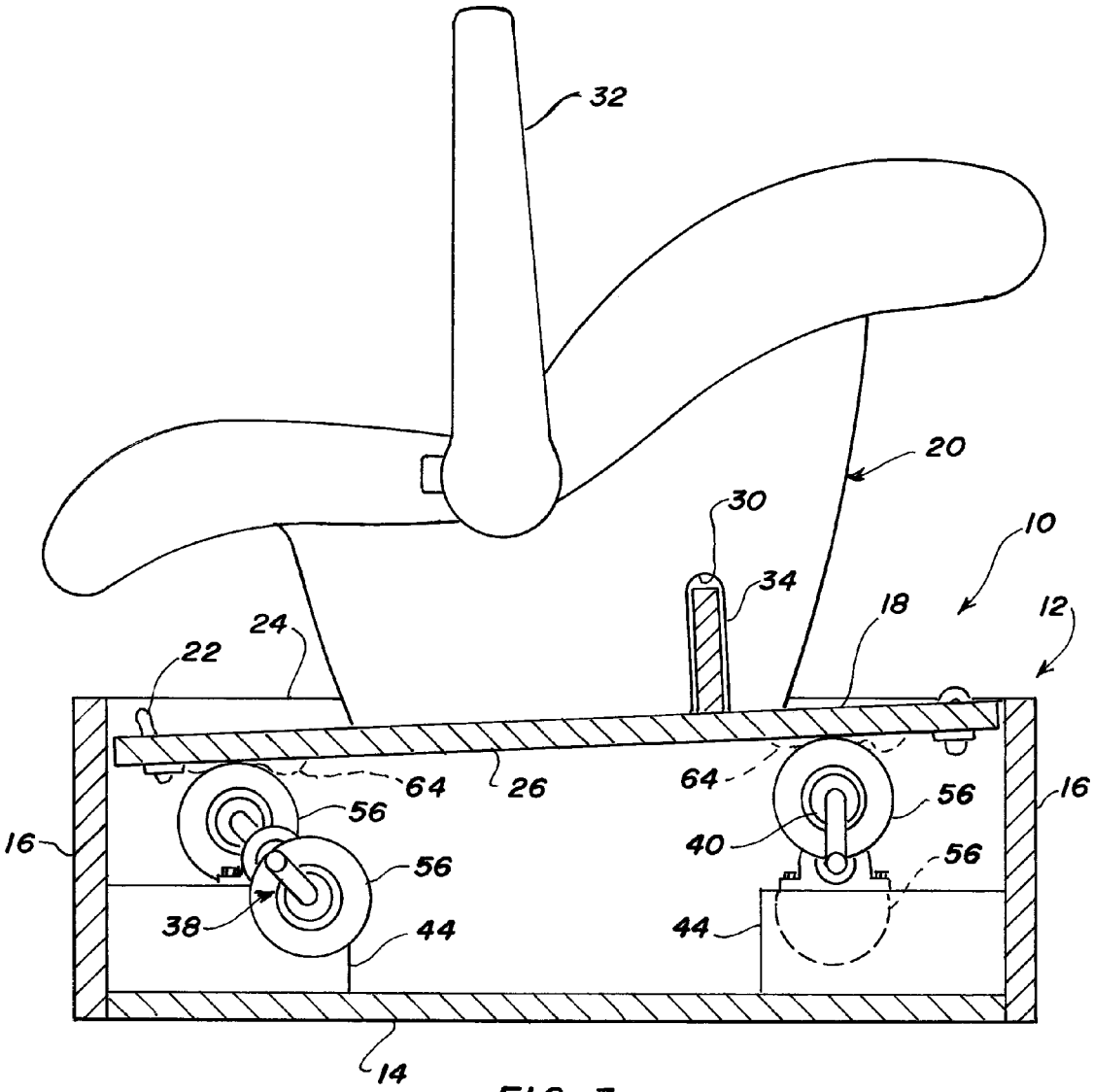
FIG. 3 is a side elevation in cross-section taken along a plane 3-3 in FIG. 7.

Referring to FIGS. 1-8 more particularly by reference character, reference numeral 10 refers to a first apparatus for simulating a moving vehicle in accordance with the present invention. Apparatus 10 includes an enclosure 12 with an open top. As illustrated in the drawings, enclosure 12 comprises a bottom plate 14 and four side wall plates 16 held to bottom plate 14 in a manner well known in the prior art in order to form a generally open topped rectangular box.

A platform 18 adapted to support a carrier 20 for an infant is suspended generally horizontally in enclosure 12 on flexible members 22. When enclosure 12 is an open topped rectangular box, platform 18 is a rectangular plate with an upper surface 24 and a lower surface 26.

Enclosure 12 and platform 18 may be fabricated, for example, by injection molding from a rigid, non-toxic, plastic such as polyethylene or polyvinyl chloride. Handles 28 (FIG. 1) may be provided for carrying purposes and enclosure 12 may be contoured such that it will not detract from the decor of a baby's room.

For the purpose of convenience, the term carrier 20 for an infant refers to any structure used to comfortably support a baby or infant. In the exemplary embodiment shown in the drawings, carrier 20 is an infant car seat but carrier 20 may be a bassinet or the like. Many infant car seats include a slot 30 by means of which carrier 20 is latched into a harness installed in a back seat of an automobile. Carrier 20 also typically includes a bail 32 by means of which carrier 20 may be carried when not installed in a car. A transverse rib 34 may be provided on upper surface 24 of platform 18 for engagement with slot 30 by means of which carrier 20 is secured to platform 18. Other attachment means such as L-shaped brackets, straps, snaps and so forth, all well known in the prior art, may be used in place of or in addition to rib 34.

Figure 8:
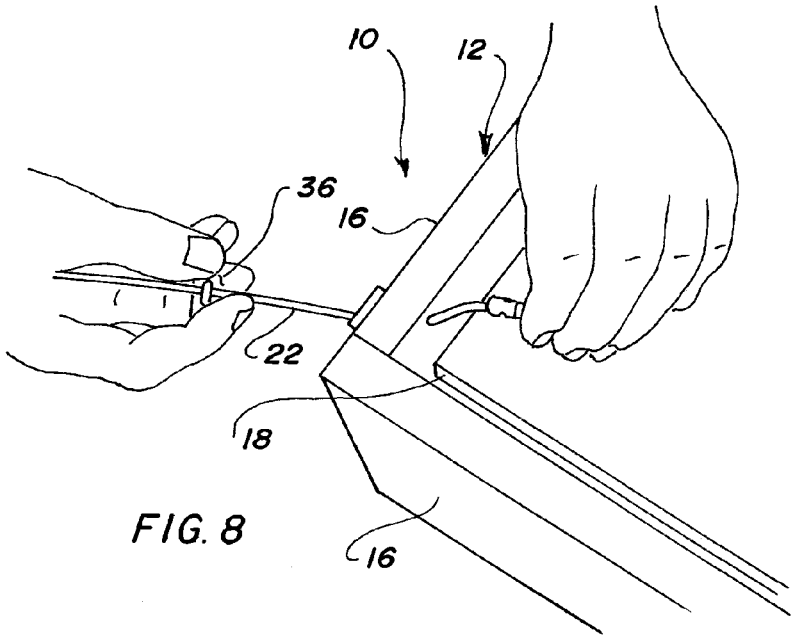
FIG. 8 is a detail in perspective illustrating one possible way to adjust of the length of a flexible member.

Platform 18 is suspended in enclosure 12 on flexible members 22 such that it has freedom of movement forward and backward, left and right and up and down. It also is free to tilt up and down, turn left and right and tilt side to side. Flexible members 22 may be wires, cables, chains or the like formed of metal or plastic that is sufficient in strength to safely bear the weight of platform 18 when loaded with an infant in carrier 20. As illustrated, one flexible member 22 is attached at each corner of platform 18. Holes are provided in opposing ones of side wall plates 16 through which a free end of flexible members 22 are passed. A retainer 36 is provided for adjusting the effective length of flexible members 22 as shown in FIG. 8.

First and second spaced apart crank shafts 38, 40 are journaled in enclosure 12. For this purpose mounting blocks may be provided on bottom plate 14 in a manner well known in the art or, as illustrated, crank shafts 38, 40 may be journaled in bearings 42 (FIG. 4) provided in opposing ones of side wall plates 16, preferably the same side wall plates to which flexible members 22 are attached. A mounting block 44 may be provided between the ends of crank shafts 38, 40 with a bearing 46 (FIGS. 5-6) in which crank shafts 38, 40 are journaled. When not journaled in mounting blocks on the inside of enclosure 12, crank shafts 38, 40 extend through side wall plates 16 for attachment to a rotary drive means 48 as more particularly described below. Otherwise, such attachment may be made within enclosure 12.

Each of crank shafts 38, 40 has at least two cranks 50, 52, the arms 54 (FIG. 4) of which may be the same length, as shown, or of different lengths. Crank shafts 38, 40 may also be linear, as shown, or non-linear in a manner well known in the prior art. Cranks 50, 52 on each of crank shafts 38, 40 may be in the same plane, as shown, or may lie in different planes and are preferably opposed such that when one of cranks 50 or 52 is up, the other is down. A rolling member 56 which may be either a wheel or a roller is mounted on each of cranks 50, 52. Rolling members 56 may be identical or may be different sizes depending on the length of arms 54 of cranks 50, 52 and on the vertical placement of bearings 42, 46.

Figure 5:
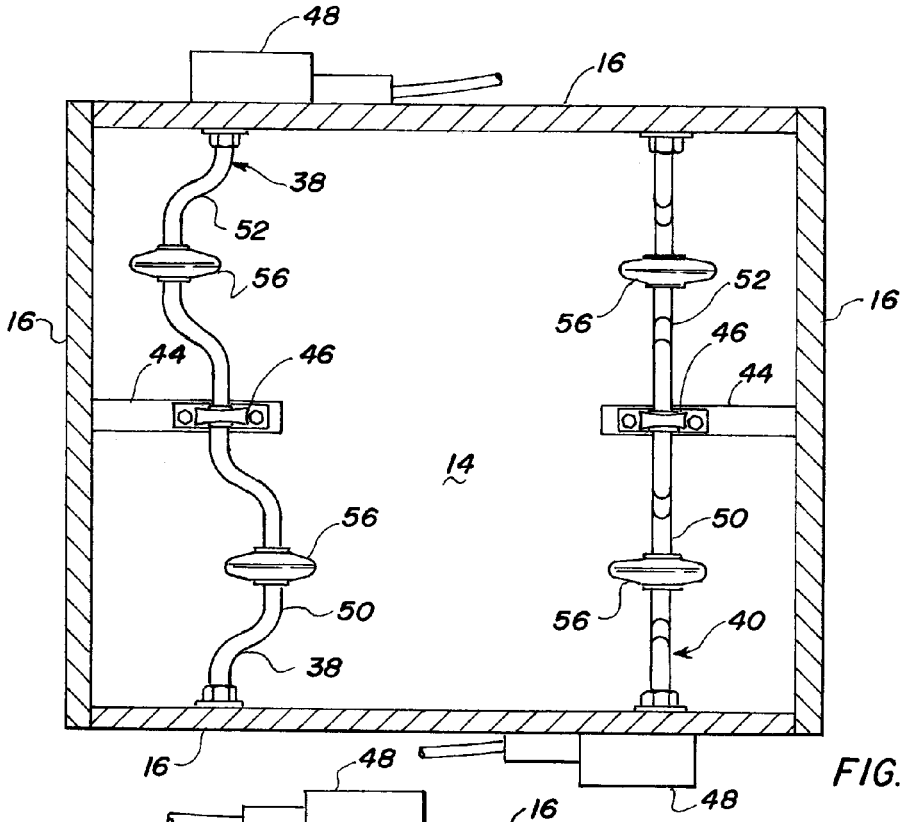
FIG. 5 is a plan view in cross-section taken along a plane 5-5 in FIG. 4.
Figure 6:
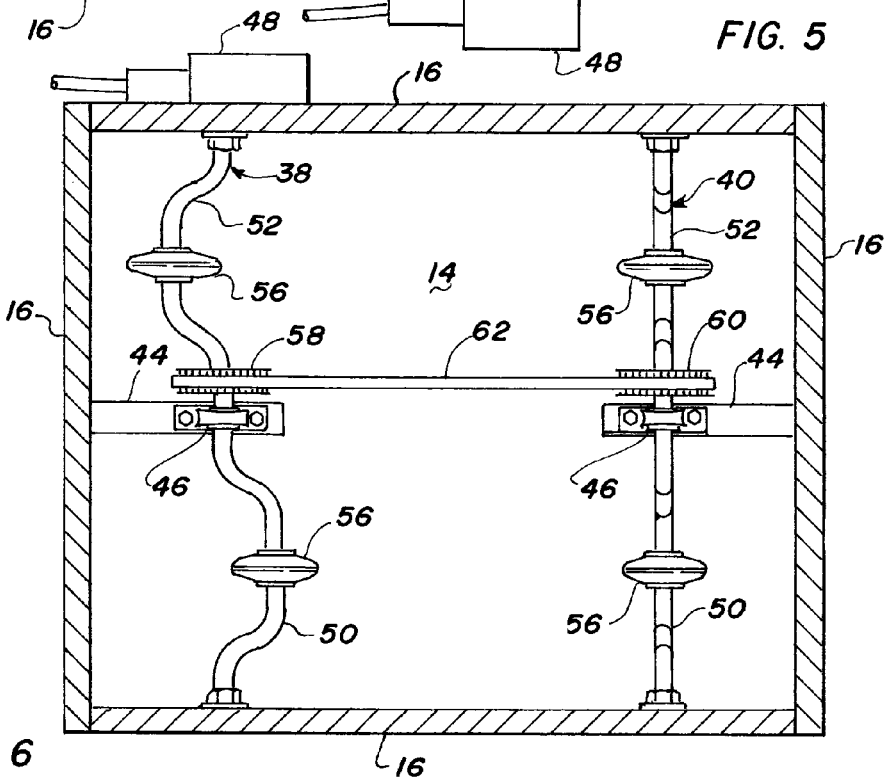
FIG. 6 is a plan view in cross-section similar to FIG. 5 but of a second embodiment.
Figure 7:
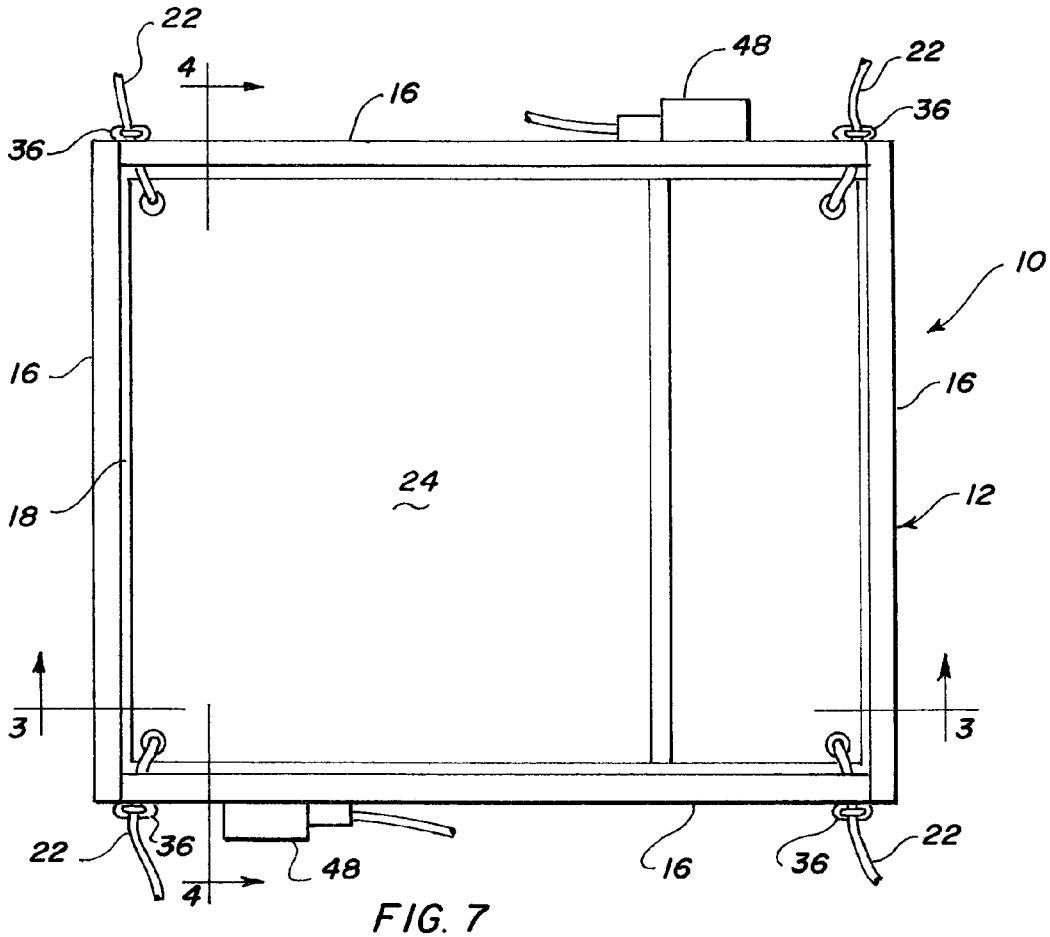
FIG. 7 is a plan view of the apparatus with the carrier removed.

As shown in FIG. 5, separate rotary drive means 48 may be coupled to each of crank shafts 38, 40 either directly or through a speed reduction means. Rotary drive means 48 may be an electric motor, as shown, of the variable speed type with voltage and/or current regulators. Electric motor 48 is connected to a power source such as a battery or wall current. As shown in FIG. 6, a single rotary drive means 48 may be used to drive both of crank shafts 38, 40 in which case a first pulley/sprocket 58 is attached to crank shaft 38 and a second pulley/sprocket 60 is attached to crank shaft 40. A belt/chain 62 connects first and second pulleys/sprockets 58, 60 such that crank shafts 38, 40 rotate in concert. With either the arrangement in FIG. 5 or FIG. 6, crank shafts 38, 40 may be arranged to rotate at the same speed or at different speeds. In the case of FIG. 5, this is accomplished through the voltage and/or current regulators and in FIG. 6 through the relative size of pulleys/sprockets 58, 60. In FIG. 6, the angular relationship between cranks 50, 52 on crank shafts 38, 40 is fixed by pulleys/sprockets 58, 60 and belt/chain 62 whereas in FIG. 5 the angular relationship will change when crank shafts 38, 40 are rotated at different speeds by separate rotary drive means 48.

In use as shown in the drawings, the length of flexible members 22 may be adjusted as shown in FIG. 8 with sliding retainers 36. As crank shafts 38, 40 are rotated by rotary drive means 48, rolling members 56 are brought into contact with lower surface 26 of platform 18 pushing platform 18 up and rolling along lower surface 26 until rotated out of contact with platform 18 on cranks 50, 52. When cranks 50, 52 are opposed to each other on each of crank shafts 38, 40, platform 18 will never have more than three-point contact with rolling members 56 and in some instances it may make no contact at all. This rising and the falling of rolling members 56 in and out of contact with lower surface 26 of platform 18 suspended on flexible members 22 sets platform 18 into a very complex motion with a long period of repetition or with no repeat at all.

By varying the tension on flexible members 22 and by varying the speed that crank shafts 38, 40 are driven, a user can find a setting that is most effective at calming an infant to induce sleep. The rising and falling, twisting and turning of platform 18 is coupled with the rolling action of rolling members 56 on lower surface 26 of platform 18 to provide a motion similar to that experienced by an infant in an automobile. The rolling action of rolling members 56 may be further enhanced, if desired, by providing corrugations 64 or the like on lower surface 26 such that the infant is gently bounced.

Figure 9:
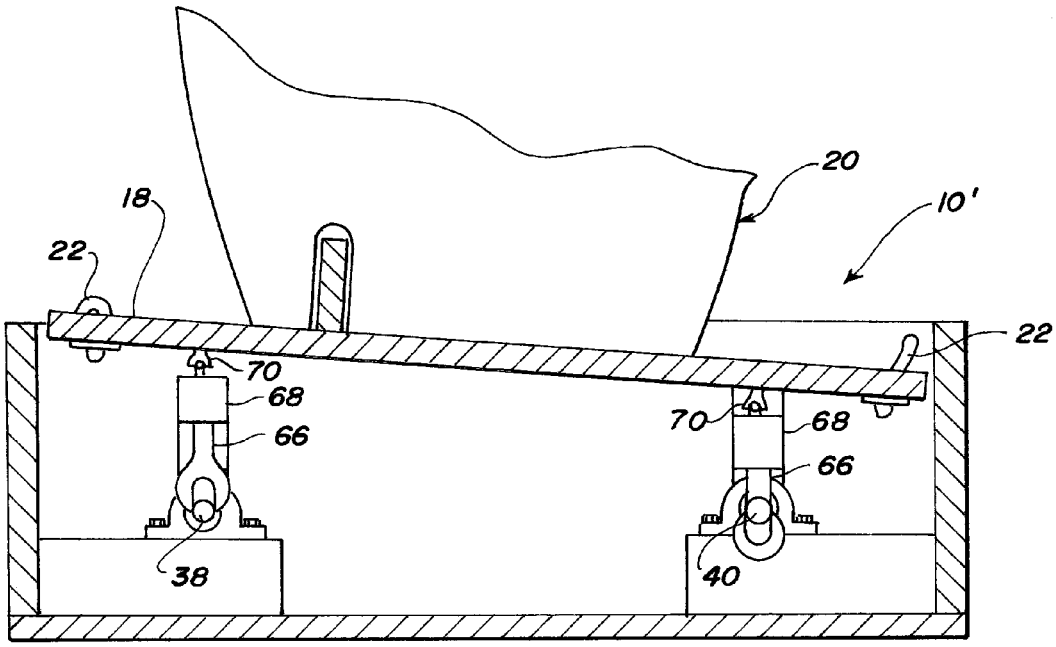
FIG. 9 is a side elevation similar to FIG. 3 of a second apparatus for applying motion simulating a moving vehicle to a carrier for an infant; and, FIG. 10 is an end elevation showing the second apparatus in cross-section similar to FIG. 4.
Figure 10:
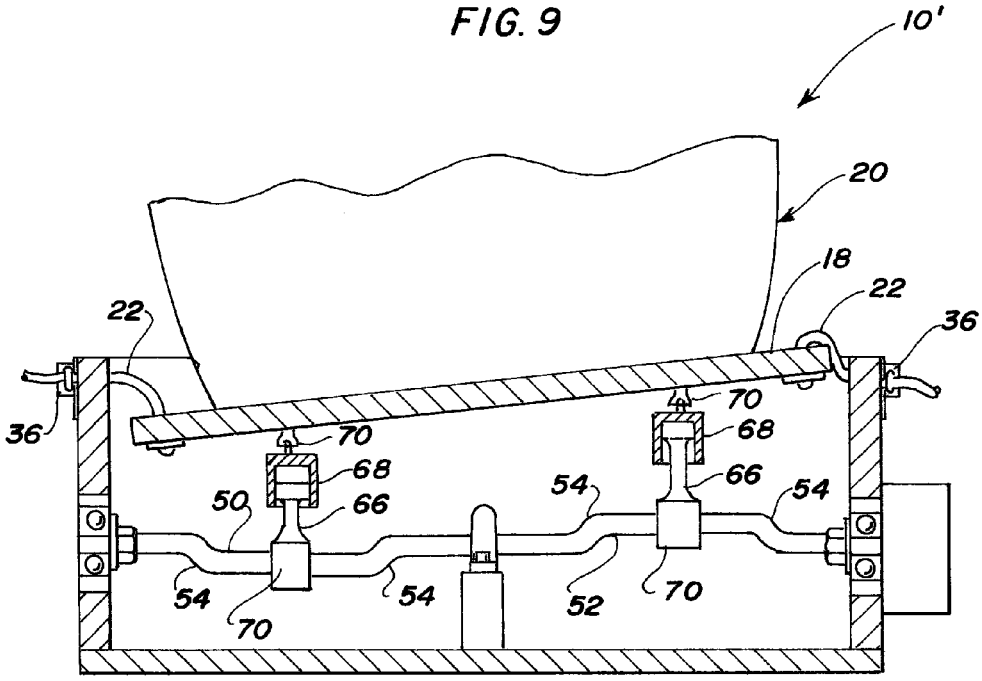

A second apparatus 10' in accordance with the present invention is illustrated in FIGS. 9-10. As shown, rolling members 56 are replaced with pistons 66 which are free to slide in vented cylinders 68 attached to platform 18. The distance traveled by pistons 66 is fixed by the length of cranks 50,52 on each of first and second crank shafts 38, 40. Both pistons 66 and cylinders 68 may be mounted on ball joints 70 to ensure non-binding reciprocating of the pistons in the cylinders. As with rolling members 56, pistons 66 are not attached to platform 18.

In operation, as pistons 66 slide in cylinders 68 a subtle vibration is transmitted to platform 18. During a cycle in some instances, the head of piston 66 contacts the bottom of cylinder 68 and lifts platform 18. In other instances, depending on the phase of cranks 50, 52 on first and second crank shafts 38, 40, the only contact between platform 18 and piston 66 is the frictional contact between the piston and the sidewalls of the cylinder. As with rolling members 56, the sliding of pistons 66 in cylinders 68 sets platform 18 into a very complex motion with a long period of repetition or with no period of repeat.

With either apparatus 10 or 10', the "ride" may take place in the comfort of a nursery where it may be easy to transfer the baby to his or her bed after he or she falls asleep, instead of trying to remove the infant from an actual car. Apparatus 10 or 10' is also useful in keeping an infant in a sleeping state after coming back from a drive, for example, to give a mother time to put away her purchases before the baby wakes up.

In view of the above, it will be seen that the several objects of the invention are achieved and other advantageous results attained. As various changes could be made in the above constructions without departing from the scope of the invention, it is intended that all matter contained in the above description or shown in the accompanying drawings shall be interpreted as illustrative and not in a limiting sense.

What is claimed:

1. An apparatus with six degrees of motion for inducing sleep in an infant comprising an open-topped rectangular box having a bottom plate and four side wall plates;

a platform having an upper surface and a lower surface, said platform suspended generally horizontally on flexible members formed of a flexible material attached to opposing side wall plates, said platform adapted to support a carrier for an infant;

first and second spaced apart crank shafts journaled in the opposing side wall plates said first and second crank shafts being below the platform, each of said crank shafts having two cranks, said cranks on each crankshaft being in the same plane but opposed to each other;

a rolling member mounted on each of the cranks, each of said rolling members being in rolling contact with the lower surface of the platform during a portion of a crank cycle;

a rotary drive means connected to the crank shafts for rotating said crank shafts;

whereby rotation of the rolling members on the cranks brings different ones of the rolling members into rolling contact with the lower surface of the platform vibrating the platform and setting the platform into motion on the flexible members.

2. The apparatus of claim 1 having means for adjusting the length of the flexible members by which the platform is suspended in the enclosure.

3. The apparatus of claim 1 wherein the cranks are mounted on crank arms having the same length.

4. The apparatus of claim 3 wherein a mounting block is provided on the bottom plate between the two cranks on each crank shaft, said mounting block having a bearing in which the crank shaft is supported and journaled.

5. The apparatus of claim 4 wherein a retainer is provided on each flexible member for adjusting the length of the flexible member supporting the platform.

6. The apparatus of claim 5 wherein a transverse rib is provided on the upper surface of the platform for mounting a car seat having a slot formed in the bottom thereof.

7. The apparatus of claim 6 wherein the rotary drive means comprises a first electric motor connected to the first crank shaft and a second electric motor connected to the second crank shaft.

8. The apparatus of claim 7 wherein the first and second electric motors are variable speed motors.

9. The apparatus of claim 6 wherein a first pulley/sprocket is provided on the first crank shaft and a second pulley/sprocket is provided on the second crank shaft, said first and second pulleys/sprockets connected with a belt/chain, and wherein said rotary drive means comprises an electric motor connected to the first crank shaft whereby rotation of the first crank shaft causes the second crank shaft to rotate also.

10. An apparatus with six degrees of motion for inducing sleep in an infant comprising an open-topped rectangular box having a bottom plate and four side wall plates;

a platform having an upper surface and a lower surface, said platform suspended generally horizontally on flexible members formed of flexible material attached to opposing side wall plates, said platform adapted to support a carrier for an infant;

first and second spaced apart crank shafts journaled in the opposing side wall plates said first and second crank shafts being below the platform, each of said crank shafts having two cranks, said cranks on each crankshaft being in the same plane but opposed to each other;

a piston mounted on each of the cranks, each of said pistons being in sliding contact with a cylinder attached to the lower surface of the platform;

a rotary drive means connected to the crank shafts for rotating said crank shafts;

whereby rotation of the pistons on the cranks brings different ones of the pistons into contact with a bottom of the cylinder vibrating the platform and setting the platform into motion on the flexible members.

11. The apparatus of claim 10 wherein the cranks are mounted on crank arms having the same length.

12. The apparatus of claim 11 wherein a mounting block is provided on the bottom plate between the two cranks on each crank shaft, said mounting block having a bearing in which the crank shaft is supported and journaled.

13. The apparatus of claim 12 wherein a retainer is provided on each flexible member for adjusting the length of the flexible member supporting the platform.

14. The apparatus of claim 13 wherein a transverse rib is provided on the upper surface of the platform for mounting a car seat having a slot formed in the bottom thereof.

15. The apparatus of claim 14 wherein the rotary drive means comprises a first electric motor connected to the first crank shaft and a second electric motor connected to the second crank shaft.

16. The apparatus of claim 14 wherein a first pulley/sprocket is provided on the first crank shaft and a second pulley/sprocket is provided on the second crank shaft, said first and second pulleys/sprockets connected with a belt/chain, and wherein said rotary drive means comprises an electric motor connected to the first crank shaft whereby rotation of the first crank shaft causes the second crank shaft to rotate also.

* * * * *